US006027435A

United States Patent [19]

Nadorf et al.

[11] Patent Number: 6,027,435

[45] Date of Patent: Feb. 22, 2000

[54] FREESTANDING PUNCHING BAG

[75] Inventors: Benjamin Nadorf, Bronx, N.Y.; Alan Weck, Fort Lee, N.J.; William Bambrough, Moberly, Mo.

[73] Assignee: Everlast World's Boxing Headquarters, Bronx, N.Y.

[21] Appl. No.: 09/223,163

[22] Filed: Dec. 30, 1998

[51] Int. Cl.[7] ..... A63B 22/14

[52] U.S. Cl. ..... 482/146; 145/51

[58] Field of Search ..... 248/519, 523, 248/346.2, 910; 482/83–90

[56] References Cited

U.S. PATENT DOCUMENTS

| | | | |
|---|---|---|---|
| 818,604 | 4/1906 | Bierd | 482/83 |
| 1,287,176 | 12/1918 | Armstrong | 482/83 |
| 1,890,696 | 12/1932 | Rosenhahn | 482/83 |
| 3,022,072 | 2/1962 | Zinnow | 482/83 |
| 4,486,016 | 12/1984 | Rubin | 482/83 |
| 5,183,451 | 2/1993 | Hautamaki | 482/86 |
| 5,330,403 | 7/1994 | Kuo | 482/83 |
| 5,624,358 | 4/1997 | Hestilow | 482/90 |
| 5,792,032 | 8/1998 | Williams et al. | 482/83 |

*Primary Examiner*—Jerome Donnelly
*Attorney, Agent, or Firm*—Lackenbach Siegel Marzullo Aronson & Greenspan, P.C.

[57] ABSTRACT

A freestanding training bag includes a pedestal having a lower surface on which the pedestal rests during normal use and an upper surface spaced above the lower surface. The pedestal defines a substantially vertical axis extending through a general central region of the pedestal and has a recess in the upper surface substantially symmetrically aligned with the vertical axis and extends from the upper surface at least partially towards the lower surface. A generally vertical post has a resilient portion in the region of the lower end of the vertical post extending into the recess and supported on the pedestal at a point below the upper surface. The post is normally substantially vertically aligned with the vertical axis prior to being struck by the user. A striking pad surrounds the post for being struck by the user. The recess serves as a limit stop to prevent excessive deflection of the post from the vertical deflection before the post bounces back after being struck by the user. In this way, the striking pad by the user causes the post to deflect a predetermined angle about the resilient portion without bending or deflecting the upper surface of the pedestal.

27 Claims, 12 Drawing Sheets

FREESTANDING PUNCHING BAG

BACKGROUND OF THE INVENTION

2. Field of the Invention

The present invention generally relates to physical fitness, exercise and sports equipment and, more specifically, to a freestanding training bag.

2. Description of the Prior Art

Training equipment designed to receive impacts from the hands, arms or feet of a user for conditioning or training purposes are well known. Such equipment is frequently used for training in the boxing and the martial arts. In the past, such equipment was typically found in gymnasiums and exercise facilities. More recently, such equipment has also found its way into the homes of consumers. Typically, such equipment includes a padded, relatively soft upright striking pad designed to receive the impacts from the arms or legs of the user, such impact receiving equipment being anchored or otherwise fixed in place so that although the striking pad is permitted to deflect as a result of the impacts, it is designed to rebound in the direction of the user. Otherwise the equipment remains substantially fixed in place relative to the ground. Such equipment is typically either very lively and responsive, to practice dexterity, agility and speed or relatively heavy and sluggish and intended to absorb significant energy impacts as a result of the power or strength of the user.

In using such training bags relatively high impact forces are initially absorbed by the striking pad and a resilient element is typically used to convert the kinetic energy from the user to potential energy. However, notwithstanding that the equipment absorbs a substantial amount of energy, it must, as suggested, remain fixed relative to the ground and, therefore, must either be permanently anchored or it must be sufficiently heavy to result in a considerable amount of friction with the floor surface. Generally, consumer units or those for children are mass produced and are freestanding and relatively light in weight. For serious or professional users the magnitude of the forces of the impact necessitates that the devices be permanently anchored to a ceiling, wall or floor, e.g., in gymnasiums. However, for most people acquiring such unit for home use attaching such unit to a wall, ceiling or floor is not a realistic or practical option. Therefore, such units need to be freestanding and be sufficiently heavy during use, to approach the professional freestanding units and develop adequate frictional forces against the floor surface to render the units immobile for the anticipated range of impact forces.

Additionally, when such exercise units are intended to practice dexterity, agility and speed it is desirable that the units simulate, at least to some extent, a live opponent. This can be achieved by making the unit such that it will efficiently restore potential energy to kinetic energy without excessive losses. Additionally, when a user is practicing timing, it is necessary that the device respond swiftly to achieve a desired rhythm. In U.S. Pat. No. 5,437,590, a multidirectional combination boxing and kicking bag is disclosed which has as its primary objective to provide an exercise which is more flexible and adapted to a number of different use conditions. However, such a bag is somewhat complex in construction and expensive to make. It is not only desirable to provide the speed of rebound to make the device "lively" but it is also desired to control the resistance to touches or kicks. Stated otherwise, the part of the device that absorbs the punches or kicks cannot be too light in weight or too heavy.

Another important consideration is durability. Such exercise equipment is designed to take a considerable amount of abuse. However, the device must withstand many impacts without causing any deterioration of any resilient or energy absorbing members. For example, in U.S. Pat. No. 5,624,358, a training bag apparatus is disclosed in which the energy absorbing element is the flat deck or upper wall of a pedestal or base of the device. The flat deck is constantly inwardly and outwardly deformed. Since a flat wall is not the best design for absorbing energy, such design may cause the upper wall to undergo fatigue and ultimate failure.

When training bags of the type under discussion are impacted by hand or by foot, the padded portion of the device is typically deflected a certain angular amount from a normally vertical orientation. It is, therefore, also desirable that the space or perimeter about the base be controlled and limited to the amount that is needed while providing the user with flexibility and versatility to simulate practice against a live opponent.

Aside from the substantive design features that go directly to the merits of operation, it is also important to consider some practical factors such storing, moving and shipping the product to customers. Although in one respect, as indicated, the base must be sufficiently heavy to make the unit a viable freestanding unit, it must nevertheless be sufficiently light in weight so that it can be easily and inexpensively shipped to customers. The device must be such that it is not excessively bulky so that it can be compactly packaged in the smallest possible containers for purposes of storage and shipment.

SUMMARY OF THE INVENTION

Accordingly, it is an object of the present invention to provide a freestanding training bag which does not have the disadvantages inherent in some of the prior art devices.

It is another object of the present invention to provide a freestanding training bag which is simple in construction and inexpensive to manufacture.

It is still another object of the present invention to provide a freestanding training bag as suggested which can be used both for kicking and punching practice in boxing and martial arts.

It is yet another object of the present invention to provide a freestanding training bag as in the previous objects which is lightweight for purposes of shipment but can be rendered heavy to effectively anchor the device or fixing same to a floor surface.

It is still a further object of the present invention to provide a freestanding training bag which can simulate, at least to some extent, a live opponent by efficiently converting kinetic energy to potential energy and vice versa as well as controlling the responsiveness or the timing to simulate counter-punches by exhibiting rapid rebound.

It is yet a further object of the present invention to provide a freestanding training bag of the type above indicated, that can provide a range of controlled resistances to punches, kicks and other impact forces on the device.

It is an additional object of the present invention to provide a freestanding training bag that is easy to move or ship.

It is still an additional object of the present invention to provide a freestanding training bag that reduces bulkiness and minimizes the volume required for storage and/or for moving purposes.

It is yet an additional object of the present invention to provide a freestanding training bag that can reduce the space perimeter around the device needed to use it while providing the user with flexibility and versatility in simulating practice against a live opponent.

In order to achieve the above objects, as well as others which will become evident hereinafter, a freestanding training bag in accordance with the present invention comprises a pedestal having a lower surface on which the pedestal rests during normal use. The pedestal also has an upper surface spaced above the lower surface, said pedestal defining a substantially vertical axis extending through a generally central region of the pedestal and having a recess in the upper surface substantially symmetrically aligned with said vertical axis and extending from said upper surface at least partially toward said lower surface. A generally vertical post is provided which has a resilient portion in the region of the lower end of said vertical post extending into said recess and supported on said pedestal at a point below said upper surface. Said post is normally substantially vertically aligned with said vertical axis prior to being struck by a user. A striking pad surrounds said post for being struck by a user, said recess serving as a limit stop to prevent excessive deflection of said post from said vertical direction before said post bounces back after being struck by the user. In this manner, striking said striking pad by the user causes said post to deflect a predetermined angle about said resilient portion without bending or deflecting said upper surface.

BRIEF DESCRIPTION OF THE DRAWINGS

Other aspects, objects and advantages of the present invention will become apparent upon reading of the following detailed description of the preferred embodiment of the present invention when taken in conjunction with the drawings, as follows.

DETAILED DESCRIPTION OF THE PREFERRED EMBODIMENTS

Figure 1:
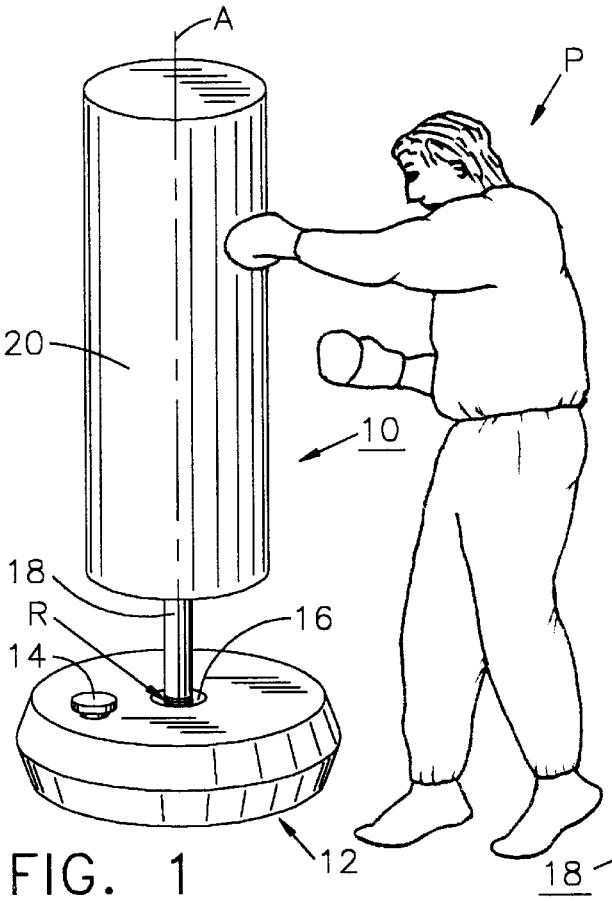
FIG. 1 is a perspective view of a freestanding training bag in accordance with the present invention, illustrating how a user might use the item for practicing punching or boxing.

Referring now more specifically to the Figures, in which identical or similar parts are designated by the same reference numerals throughout, and first referring to FIG. 1, the freestanding training bag in accordance with the present invention is generally designated by the reference numeral 10.

The training bag 10 includes a pedestal or base 12 which is generally hollow and forms a sealed container or chamber 12' (FIGS. 4 and 9) for any fluid or liquid material, such as water, sand or the like. For this purpose there is provided a plug 14 which plugs an opening or hole 14' (FIG. 2) that can be selectively removed to fill the pedestal. The hole 14' is preferably 1.25 inches or greater in diameter so that the pedestal can be filled with a garden hose. When the plug 14 is in place, however, it preferably provides a good seal to prevent water, for example, from escaping from the pedestal.

The specific shape or configuration of the pedestal is not critical for purposes of the present invention as long as it is provided with a lower or bottom surface that provides the pedestal with adequate support when placed on a support surface such as a floor. In the embodiments to be described, the bottom surface or wall **12*a* (FIG. 4) is generally flat since it is contemplated that the pedestal will normally be used on flat floor surfaces. As will be described hereinafter, the pedestal may be round, as shown in FIG. 1, square, as shown in FIGS. 2–5**, or any other suitable or desirable configuration.

The pedestal 12 defines a substantially vertical axis A (FIG. 4) extending through a generally central region of the pedestal as shown and has a recess 16 in the upper surface or wall **12*b*** substantially symmetrically aligned with the vertical axis A and extending from the upper surface or wall at least partially towards the lower surface or wall of the pedestal.

Arranged along the substantially vertical axis A is a generally vertical post 18 which has a resilient portion R, to be more fully described below, at the lower end of the vertical post 18 extending into the region of the recess 16. The post 18 is supported on the pedestal 12 at a point below the upper surface 12*b*. The post 18 is normally substantially vertically aligned with the vertical axis A prior to being struck by a user, as shown in FIG. 1.

A striking pad 20 is provided which is generally in the form of an elongate upright cylindrical member typically foam-filled and provided with a longitudinal hollow core 20' (FIG. 9) dimensioned to receive the upper portion of the post 18. The striking pad 20 is designed to absorb impacts from the user. The specific construction of the striking pad is not critical for purposes of the present invention, and any known or suitable constructions currently being used for this purpose may be used.

Figure 4:
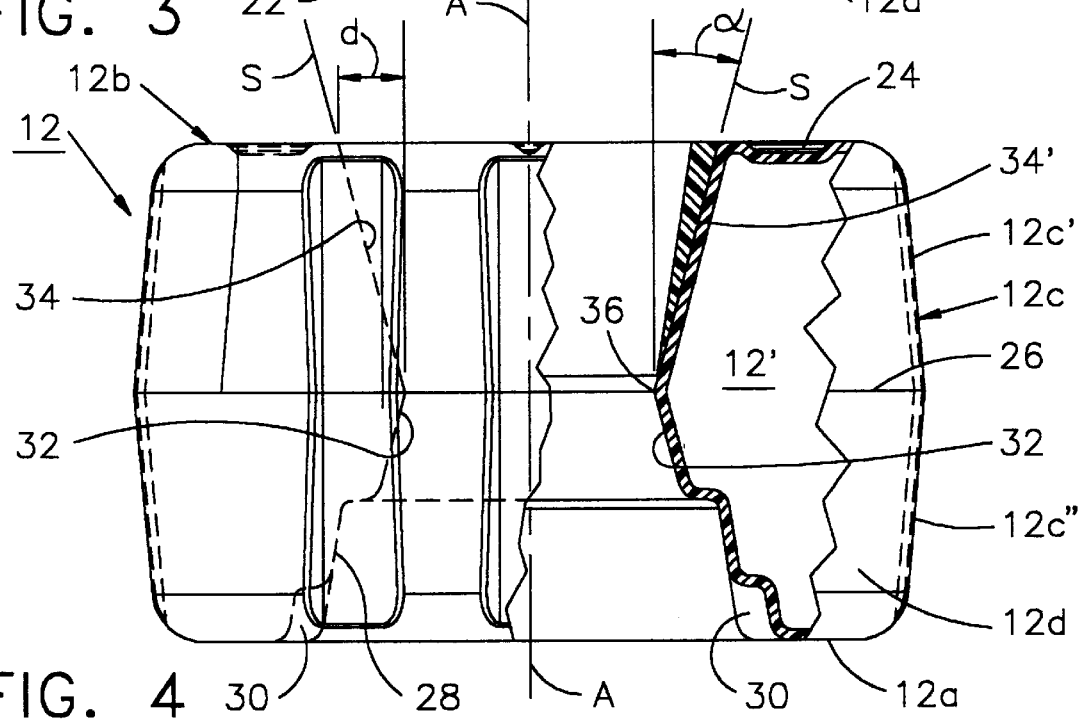
FIG. 4 is a side elevational view of the pedestal or base shown in FIGS. 2 and 3, partially broken away to illustrate the interior or central channel or opening for receiving the post.
Figure 9:
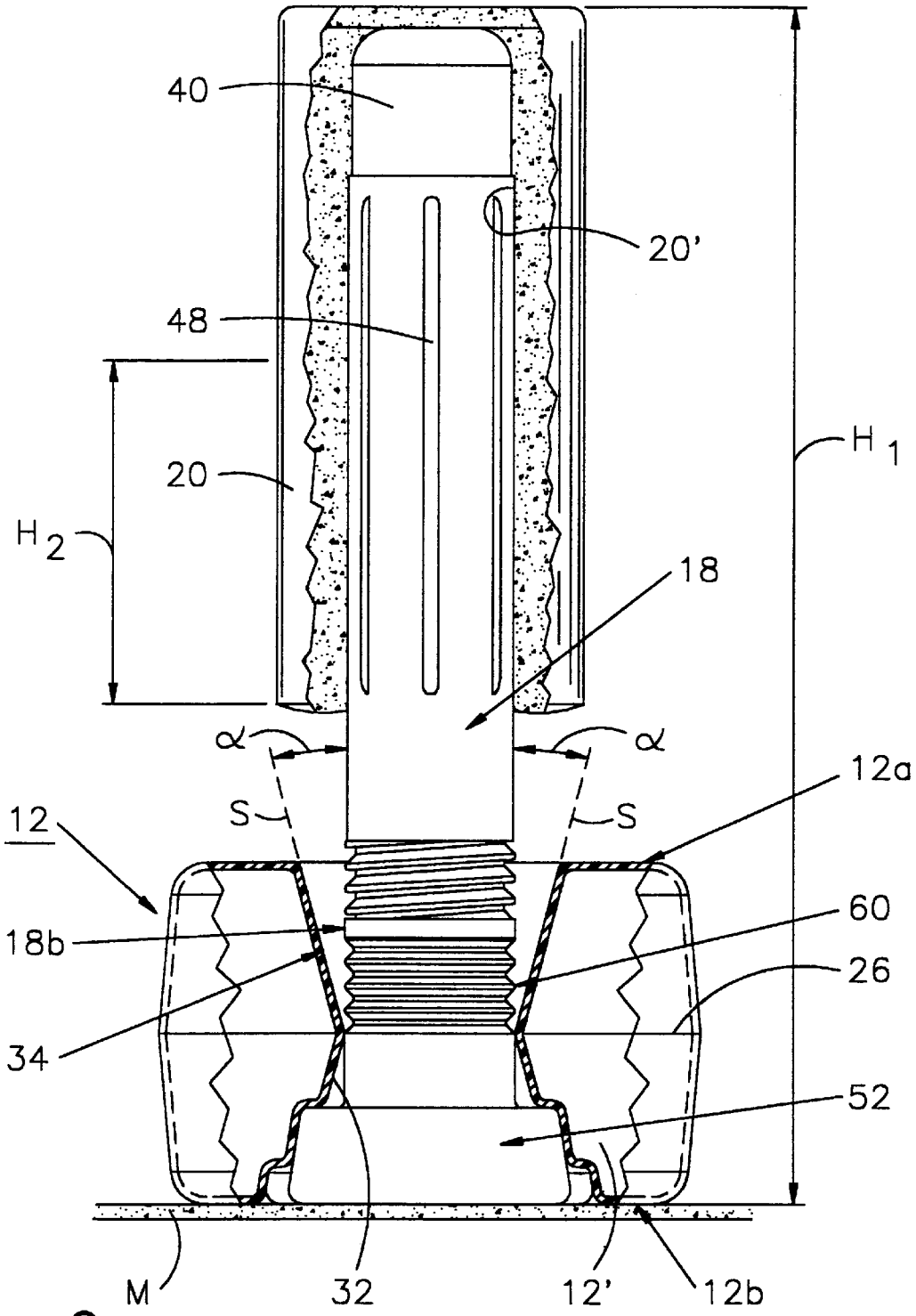
FIG. 9 is a diagrammatic front elevational view, partially broken away, of the training bag shown in FIG. 2, illustrating the manner in which the post is supported by the base and the striking pad is mounted on the post.

When the user P hits the striking pad 20 the impact force angularly deflects the post 18 from its normally orientation and angularly deflects it about a point in the region of the recess 16 an angle α in relation to the axis A (FIGS. 4 and 9). As will be more fully described below, the surface forming the recess 16 serves as a limit stop to prevent excessive deflections of the post from the vertical direction before the post bounces back or rebounds after being struck by the user. In this manner, striking of the striking pad by the user causes the post to deflect a predetermined angle in the region of the recess 16 without bending or deforming the upper surface 12*b* of the pedestal.

Figure 2:
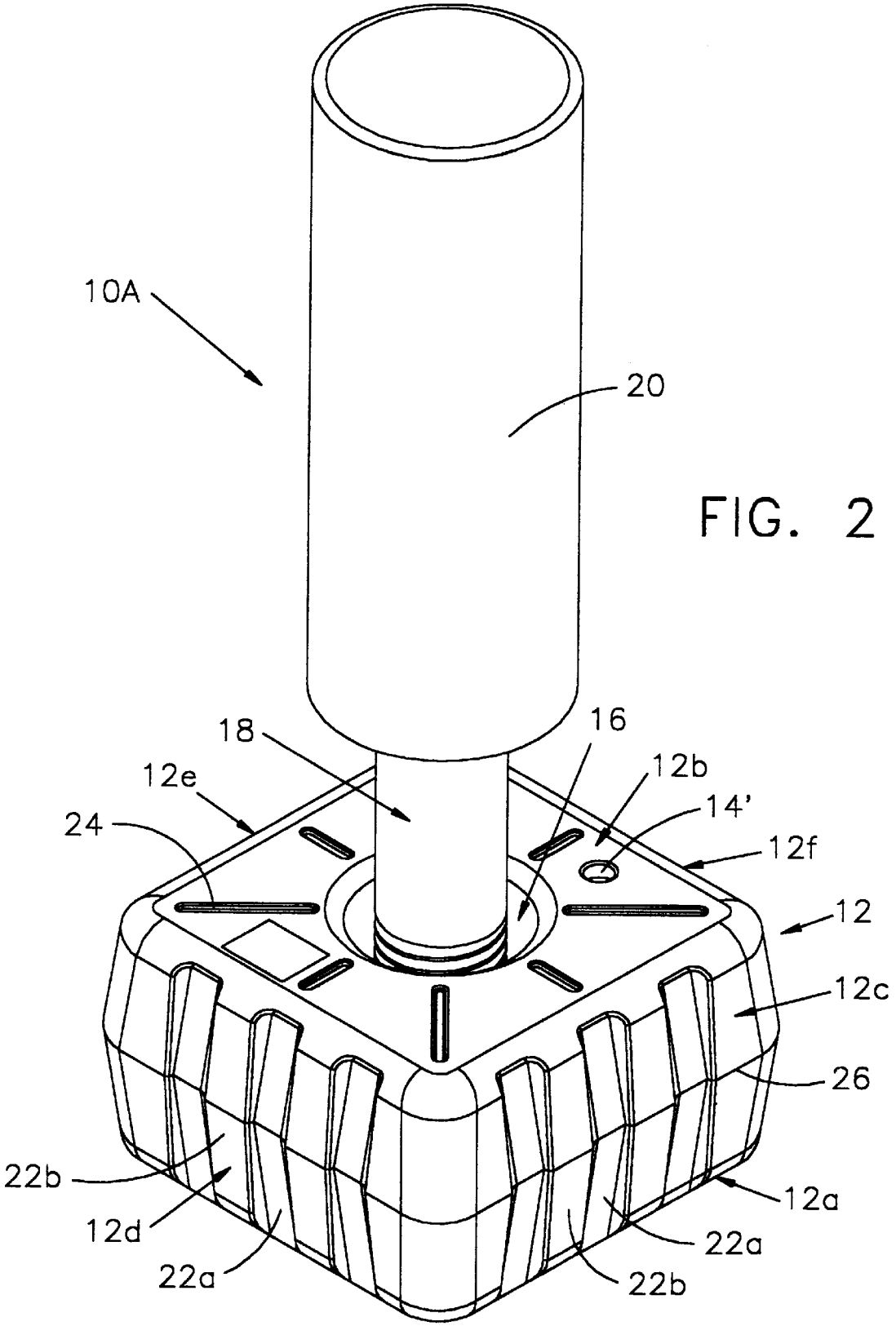
FIG. 2 is a perspective view of a freestanding training bag similar to the one shown in FIG. 1, but indicating some additional details of one embodiment of the invention.
Figure 3:
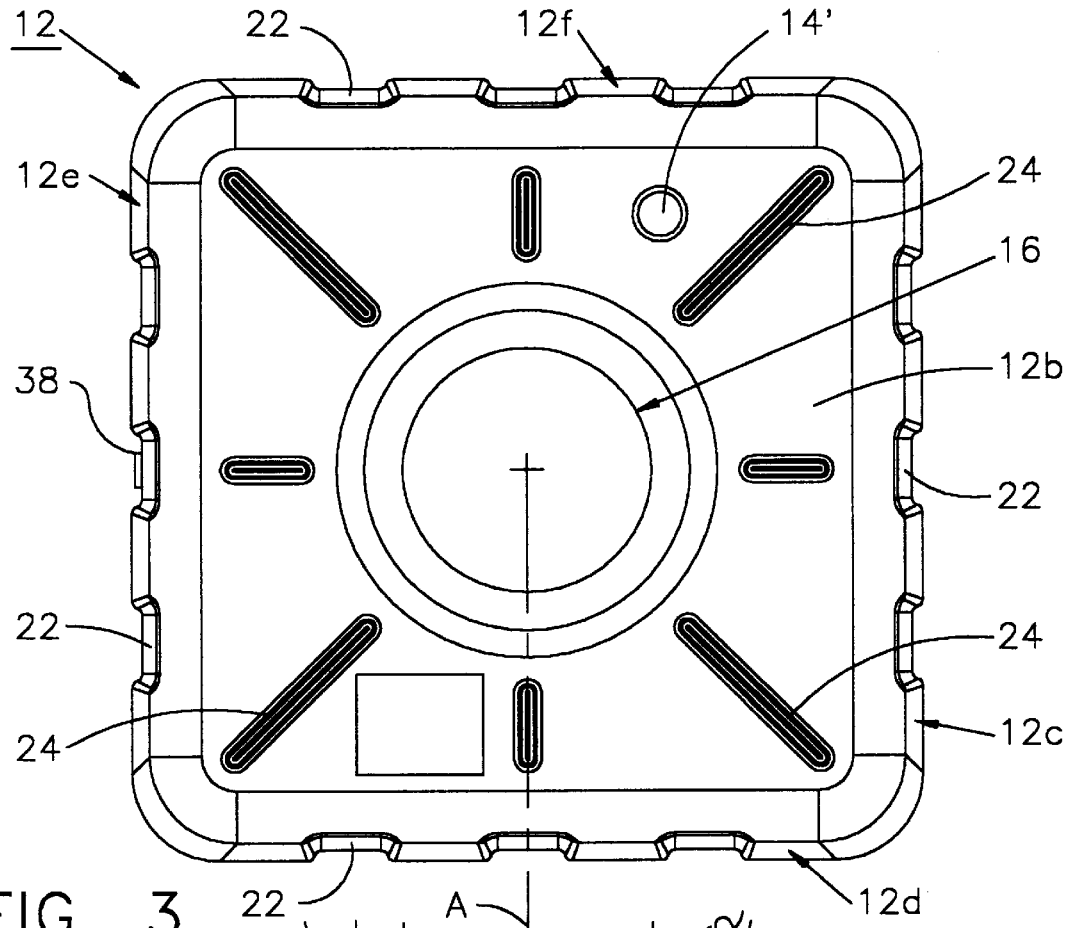
FIG. 3 is a top plan view of the base of the training bag shown in FIG. 2.

Referring to FIG. 2, another embodiment 10A of the training bag is shown in which the pedestal or base 12 is generally square in configuration, having a generally flat upper surface or wall 12*b*, lower surface or wall 12*a* and generally equal side surfaces 12*c*–12*f*. The base may be made from any conventional material suitable for the purpose, such as being blow molded from high density polypropylene. When formed of a relatively thin plastic material, the side walls are preferably formed with spaced vertical recesses 22*a* to create vertical ribs 22*b*, as shown, that serve to reinforce and strengthen the side walls. The ribs stiffen the side walls and make the side walls more resistant to bowing out when the pedestal is filled with a liquid, such as water. Similarly, a series of radially directed ribs 24 are formed in the upper surface or wall 12*b* to rigidify and stiffen it to resist bending or deformation of the upper surface where the post 18 is deflected and impacts against the upper portion of the pedestal within the recess 16. While specific examples of ribs or stiffening members have been illustrated, it will be clear that these are merely illustrative and any other suitable or conventional means for stiffening the side walls and the top wall may be used.

Figure 6:
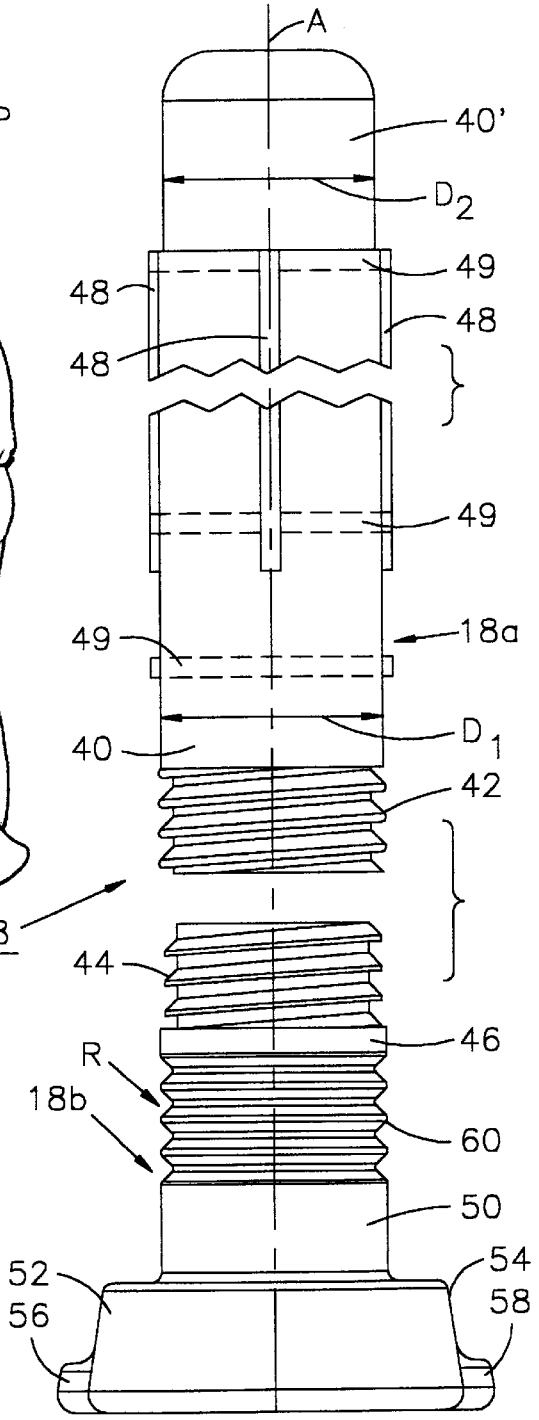
FIG. 6 is an exploded side elevational view of the post used in the embodiment of FIG. 2, illustrating the lower portion of the post which is received within the central opening in the base and the upper portion of the post which projects above the base and supports a striking pad.

The post 18 is secured to the pedestal 12 at least during use. As will become evident from the description that follows, the post can, in some instances, be a separate component that can be separated from the pedestal or base for purposes of storage and/or shipment or may be permanently fixed or integrally formed with the pedestal. In the embodiment 10A, the post 18, to be more fully discussed in connection with FIG. 6, is a separate component that needs to be secured to the pedestal 12 during use. For this purpose, a lower cavity 28, best shown in FIG. 4, is provided extending from the lower surface or wall 12*a* extending upwardly to a point generally below a central parting line at 26. The specific size or configuration of the lower cavity 28 is not critical but is preferably configured to facilitate insertion of a corresponding or mating portion of the post 18, as to be described. In the embodiment 10A, the lower cavity 28 is generally in the shape of a truncated conical surface and, therefore, is substantially symmetrical about the axis A. To prevent rotation of the post 18 about the axis A, in response to impacts, the lower cavity may also have different, non-circular configurations such as square, octagonal, etc. However, when a generally circular lower cavity is used, there are preferably provided at least one additional locking recess 30 for receiving corresponding or mating locking ears or portions on the post. As indicated in FIG. 4, the embodiment 10A has two diametrically opposite locking recesses 30, although it will be clear that any number of such recesses may be used.

In the pedestal 12 of the embodiment 10A the recess forms part of a central opening 29 that extends through the entire height of the pedestal. The central opening 29 includes a lower converging taper 32 that converges from the lower cavity 28 up to the parting line 26 and an upper diverging taper 34 that diverges from the parting line 26 up to the upper surface 12*a*. The upper taper 34 serves as the recess 16. In the embodiment 10A, therefore, there is formed a continuous channel or central opening 29 that extends through the entire height of the pedestal. While the angle defined by the lower converging taper 32 is not critical, the upper converging taper 34 preferably forms an angle α with a vertical direction parallel to the axis A, the angle α to defining the desired limit or stopping position for the post 18. Clearly, the larger the angle α the more that the post 18 will be able to be deflected before it engages and is stopped by the pedestal upper diverging taper 34 surface. The angle α can, therefore, be used to control the responsiveness (or sluggishness) and liveliness of the rebounds by effectively limiting the amount of deflection of the post in response to impact by the user. The specific angle α is not critical and any angle greater than 0° can be used, with different degrees of advantage. A practical range for a is 5°–60°, although a preferred range is 5°–45°. It has been found, however, that an angle of approximately 13° or a distance "d" (FIG. 4) of approximately 2 inches at the top of the recess is suitable for most users. A feature of the present invention is that the angle α a can be changed by insertion of a suitable annular insert 34' which reduces the angle α and, therefore, makes it more lively or responsive. The insert 34' may be edged into the recess 16 or may be secured by any suitable detent (not shown) that allows the insert to be snapped into position.

Figure 5:
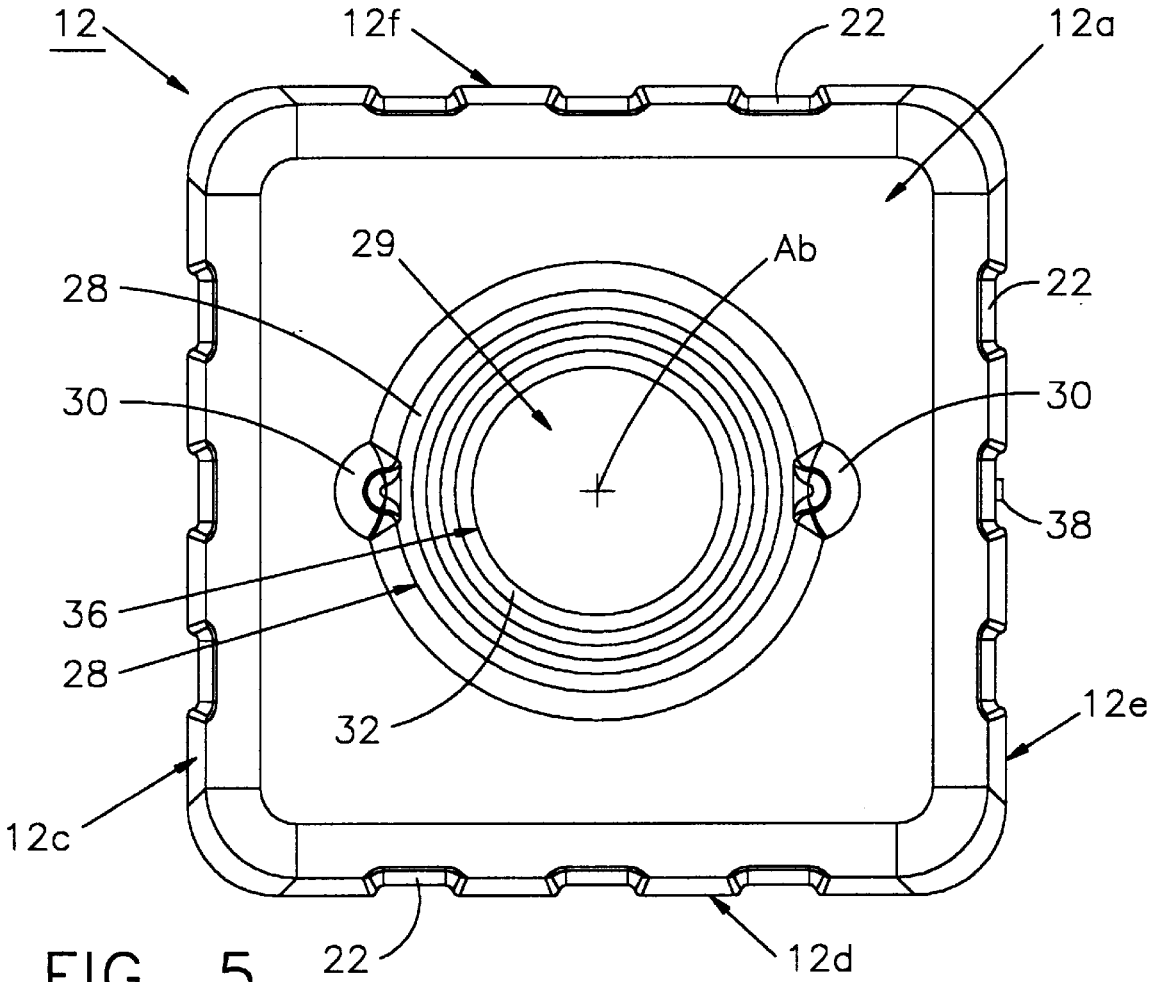
FIG. 5 is a bottom elevational view of the base or pedestal shown in FIG. 3, illustrating the details of the lower cavity for receiving an enlarged portion of the post and recesses for receiving the locking ears or tabs to prevent the post from rotating relative to the base.
Figure 7:
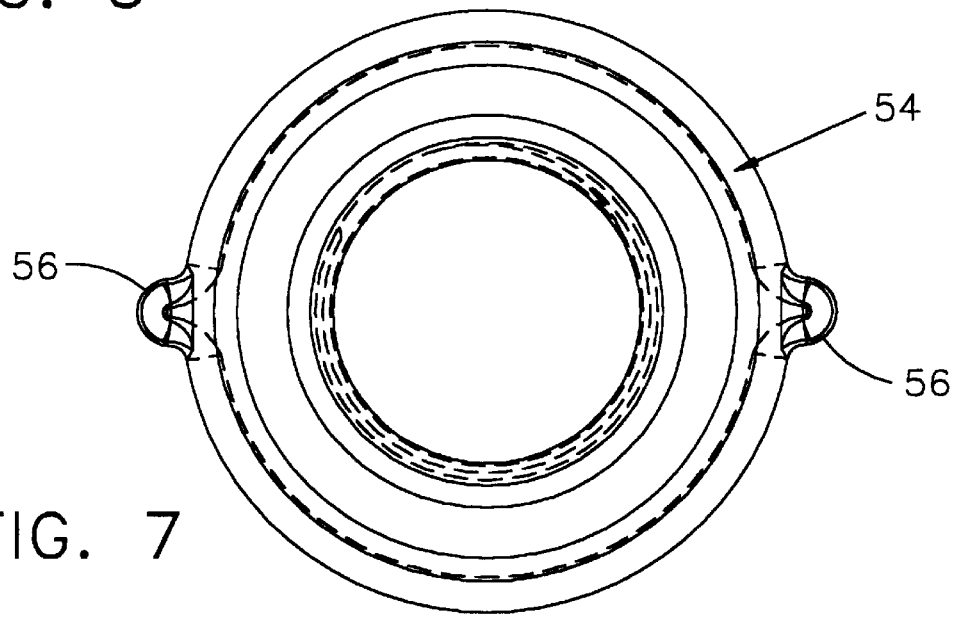
FIG. 7 is a bottom elevational view of the post shown in FIG. 6, illustrating the details of the ears or locking tabs which are receivable within the locking recesses in the pedestal shown in FIG. 5.

Referring to FIG. 5, the details of the lower cavity 28 are illustrated as viewed from the bottom of the pedestal 12. It will be clear that the configuration of the central opening 29 in the pedestal is relatively wide at both the bottom and top walls 12*a*, 12*b*, with constrictions in between that can serve as means for capturing the post 18 within the resulting central through opening 29 when used with an appropriately configured post.

Figure 8:
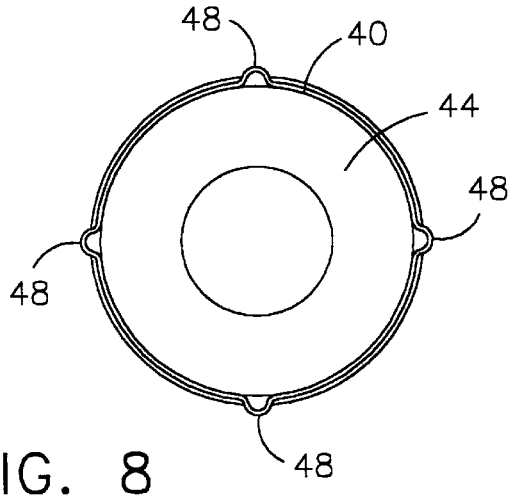
FIG. 8 is a top plan view of the upper portion of the post, illustrating the outwardly projecting longitudinal ribs for engaging the striking pad and preventing the rotation of same about the post.

Referring to FIG. 6, the details of the post 18 shown in FIG. 2 are illustrated. The post 18 includes an upper portion 18*a* which is generally in the form of an elongate tube 40 provided at the lower end with an internal threaded portion 42 which corresponds to the external threads 44 on a lower portion 18*b* of the post so that the upper and lower portions 18*a*, 18*b* can be selectively connected or disconnected from each other. Also referring to FIG. 8, the tubular portion 40 is preferably provided with circumferentially spaced longitudinal ribs 48 dimensioned to engage the internal surface of the striking pad 20 to prevent or minimize relative rotational movements of the pad about the upper portion of the post when it is struck by a user. Thus, when the hollow longitudinal cavity or bore 20' within the striking pad is selected to have a diameter which is equal to or somewhat less than the diameter $D_1$ of the tubular portion 40, the ribs 48 will frictionally engage the internal surface of the striking pad and tend to reduce such undesired rotationally movements.

Similarly, circumferential ribs 49 are advantageously provided that are axially spaced from each other along the post to inhibit or prevent the striking pad 20 from moving relative to the post 18 along the axis A. The spacing between the ribs 49 is not critical but may be substantially uniformly spaced from each over the area of the post received within the striking pad. Therefore, the spacing between the ribs may vary with the length or height of the striking pad used. For one of the shortest bags used, a 36 inch bag, three ribs 49 may be spaced approximately 10–12 inches apart. Both the ribs 48, 49 may project any practical or useful distance to engage a particular type of striking pad. For foam striking pads the ribs may project approximately ⅜ inch or any other suitable distance to provide the necessary friction fit to prevent or minimize relative movements.

The lower post portion 18*b* also has a tubular portion 50 that substantially corresponds to the smallest internal diameter or region of maximum constriction 36 in the central opening 29, an enlarged foot portion 52 being provided at the lower end of the tubular portion 50. The foot portion 52 is dimensioned and configured to be received within the lower cavity 28 with little clearance. Since the transverse or diametrical dimensions of the foot portion 52 are larger than the remaining dimensions of the central opening 29 it will be clear that insertion of the lower portion 18*b* through the bottom of the pedestal 12 will cause the foot portion 52 to be received and become seated within the lower cavity 28 and become captured against further upward movements relative to the pedestal, and thereby become fixedly secured when the external tapered surface 54 engages and abuts against the correspondingly tapered surface of the lower cavity 28.

The foot portion is also provided with ears 56, 58 dimensioned and positioned to be receivable within the locking recesses 30 so that the lower portion 18*b* becomes additionally locked in place against movements about the axis A. With this construction, therefore, once the foot portion 52 is fully seated within the lower cavity 28 it becomes effectively fixed or permanently secured to the pedestal.

The lower post portion 18*b* is also provided with a resilient portion R between the external thread 44 and the tubular portion 50. An additional tubular portion 46 may be provided between the resilient portion R and the external thread 44 as shown. The resilient portion R, as above indicated, is configured to provide an efficient region on the post to permit extensive bending or flexing without compromising the integrity of the material. In the embodiment shown in FIG. 6, the resilient portion R is the form of a bellows 60 which is integrally formed with the lower portion 18*b* of the post. However, as will be evident from the discussion that follows, the specific nature of the resilient portion R is not critical and various resilient portions may be used. It will further be evident that once the upper post portion 18*a* is attached to the lower portion 18*b* by means of the threaded regions 42, 44, any deflections of the upper portion 18*a* will result in bending or flexing of the bellows 60 if the regions below the bellows are fixed in place. Once the pedestal 12 is filled with liquid, such as water, through the hole or opening 14', it becomes heavily weighed and bears down on the enlarged foot portion 52 to essentially immobilize it. However, it will be evident that the bellows will permit deflection of the post, to a degree. If the resilient portion or bellows is very soft or resilient even a slight transverse force applied to the upper portion 40 will cause significant angular deflections from the vertical about the bellows. If the resilient portion is stiff or rigid less deflection may result or a greater force may be needed to be applied. However, irrespective of the characteristics of the resilient portion R, the upper diverging taper 34 forming part of the recess 16 will serve as a limit stop to prevent further deflection of the tubular portion 40 of the post once it engages or abuts against the taper 34. At such time as the tubular portion 40 impacts on the upper diverging taper 34 and bounces back, it converts potential energy stored in the resilient portion R back to kinetic energy. The potential energy is created by the user P. When the striking pad is initially struck, the impact causes the kinetic energy imparted to the striking pad to be converted into potential energy as the resilient portion R, such as the bellows 60, becomes deformed to store the energy.

Figure 12:
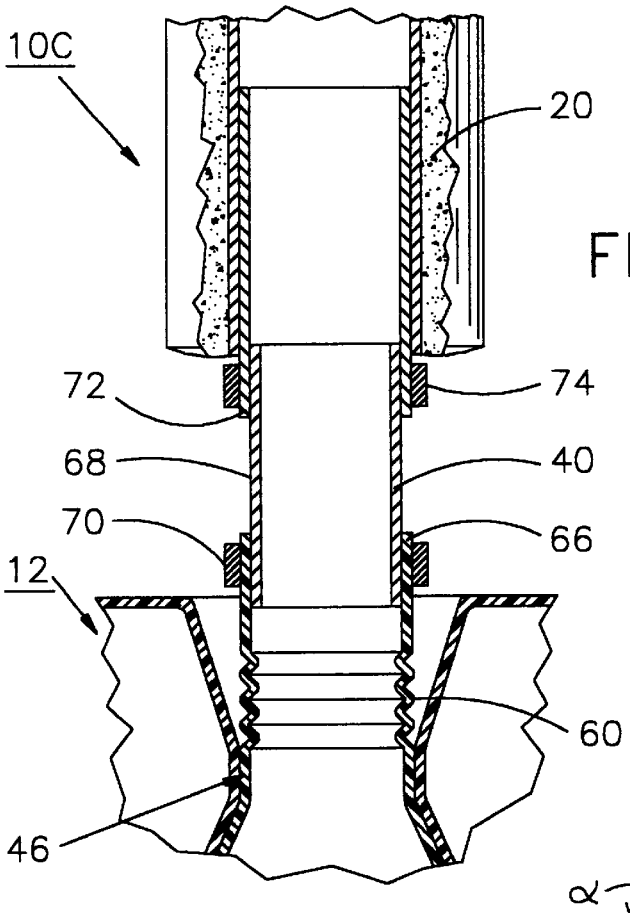
FIG. 12 is a side elevational view of another embodiment in accordance with the invention.

Preferably the upper end 40' of the upper portion 18*a* is provided with a reduced diameter $D_2$ which is smaller than the diameter $D_1$ of the tubular portion 40, the diameter $D_2$ being selected to substantially correspond to the inside diameter of the tubular portion 40 so that the upper portion 18*a* may be extended axially or vertically by inserting the upper end 40' into an extension tube (not shown) similar to the tubular portion 40. A longer upper tube could then support a longer or taller striking pad 20. Typical heights of striking pads are 30, 42, 60 and 72 inches. By providing tubular extensions to an initially short tubular portion or by providing a telescoping arrangement as shown in FIG. 12, the user can change the weight $H_1$ of the training device and striking zone $H_2$.

FIG. 9 diagrammatically illustrates an assembled free-standing training bag in accordance with the invention, showing the manner in which the striking pad is mounted on the tubular portion 40 of the post and the manner in which the lower portion 18*b* of the post is secured within the pedestal. The dashed lines S in FIG. 9 illustrate the stop or limit positions for angular or deflecting movements of the post, corresponding to the angle $\alpha$ defined by the upper diverging taper 34.

While the dimensions of the training bag are not critical, the height $H_1$ can be 72 inches while the striking zone $H_2$ can extend to 58 inches above the ground. A substantially square pedestal of the type shown in FIGS. 2–8 having a height of approximately 18 inches and being 26 to 28 inches on a side can contain 50 gallons of water to provide a total weight of the pedestal, when filled, of 400 pounds. This weight should be adequate to secure the pedestal on a floor surface for most or typical impacts that are anticipated for average use. The tubular portion 40 may have a diameter of 8–9 inches.

Also shown in FIG. 9 is a mat M that may be placed between the pedestal 12 and a floor surface to increase the frictional surface therebetween to prevent shifting or movements of the pedestal in response to impacts.

Figure 10:
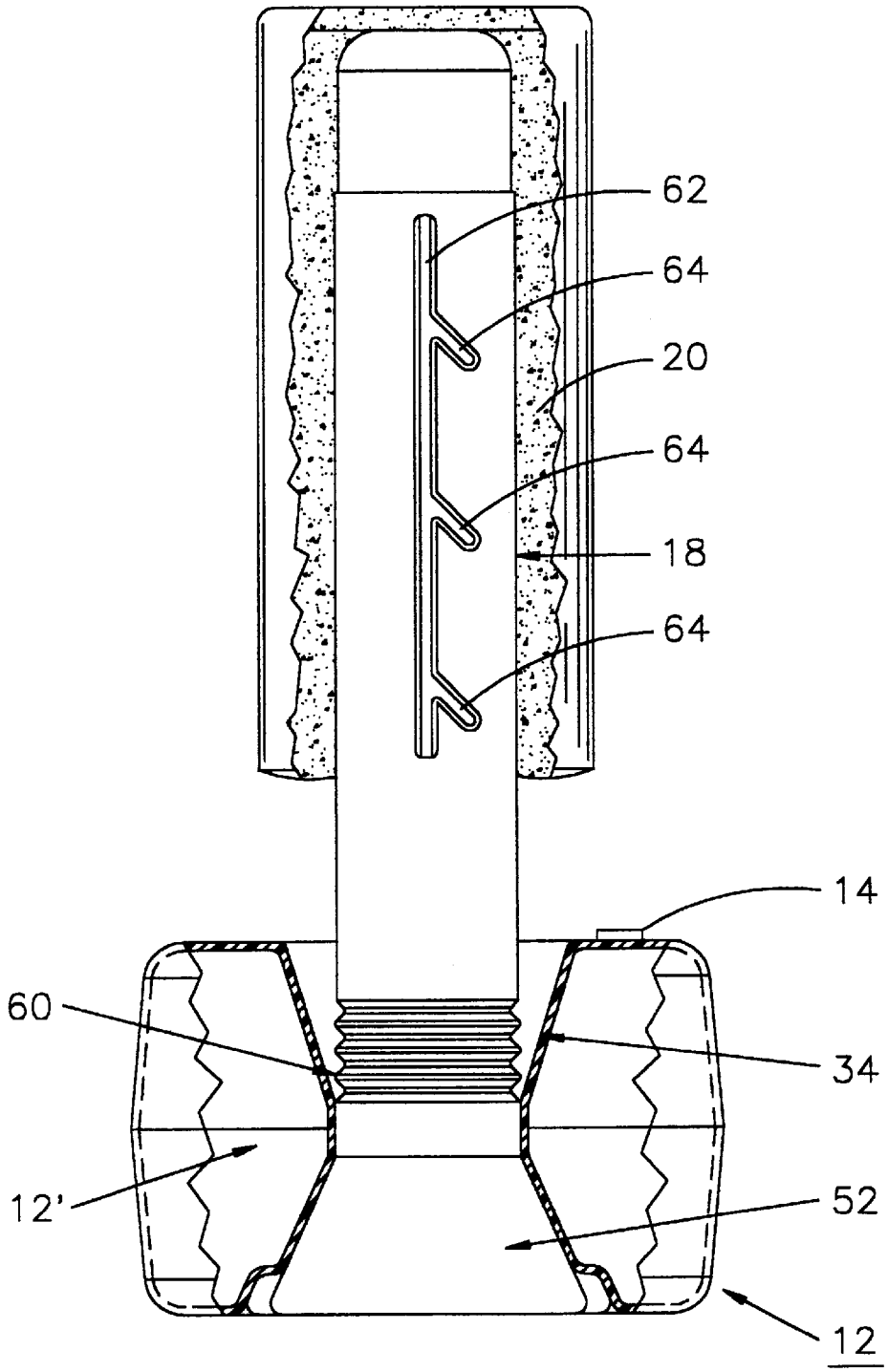
FIG. 10 is similar to FIG. 9, but illustrating a variant embodiment thereof.
Figure 11:
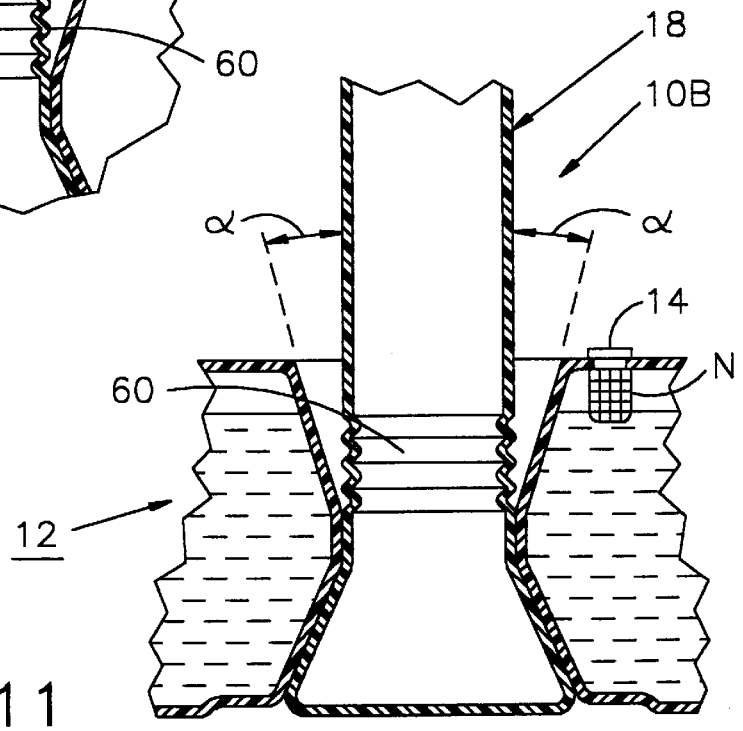
FIG. 11 is a diagrammatic fragmented side elevational view of the embodiment shown in FIG. 10.

In FIGS. 10 and 11, a further embodiment 10B is illustrated in which the entire post is integrally formed, so that the threaded regions 42, 44, of the embodiment 10A have been eliminated. The embodiment 10B also illustrates another arrangement for securing the striking pad 20 against movements relative to the upper portion 18*a* of the post. A longitudinal slot 62 is provided from which there extends a plurality of spaced laterally and downwardly directed openings 64. A suitable pin (not shown) on the internal surface of the striking pad, projecting outwardly, can be inserted into the slot 62 to guide the pin upwardly or downwardly. When the striking pad is at a desired height it is rotated into one of openings 64 to secure the striking pad at the desired height, while reducing the ability of the striking pad from moving relative to the post.

Referring to FIG. 12, another embodiment 10C is illustrated in which a segmented telescoping post is used having a lower portion 18*b* similar to the one illustrated in FIG. 6. However, a tubular upper end or collar 66 is provided above the bellows 60 which has an internal diameter substantially corresponding to the external diameter of a tubular lower end 68 of the tube 40. By mating these ends as shown in FIG. 12, they may be joined by tightening the tubular upper end 66 against the tubular lower end 68 by any conventional means, such as a hose clamp 70. Also, if desired, a similar arrangement may be used at the upper end where an adjustable tube 72 can be raised or lowered and fixed in place by an adjustable hose clamp 74. The striking pad 20 is then mounted and fixed to the adjustable tube 72 in any suitable or conventional manner, as suggested previously. This telescoping construction, while somewhat more complex, provides significant flexibility in adjusting the height of the striking pad 20.

Figure 13:
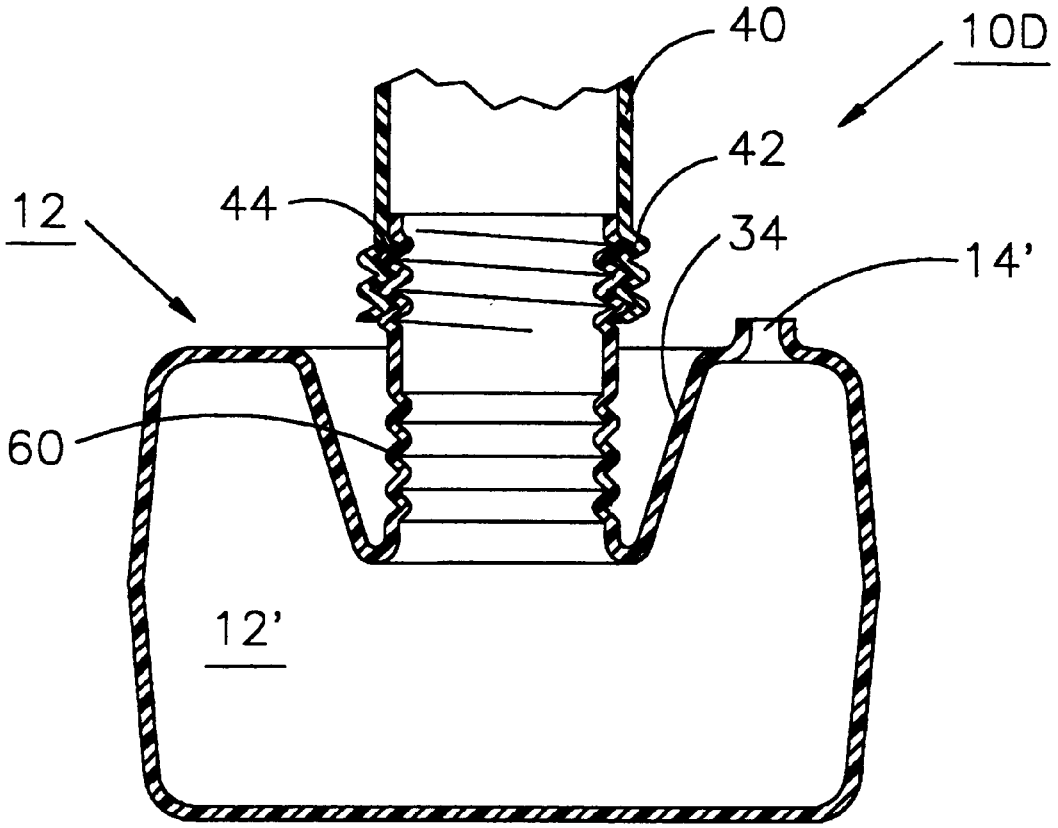
FIG. 13 is a cross sectional view of still another embodiment in accordance with the invention.
Figure 14:
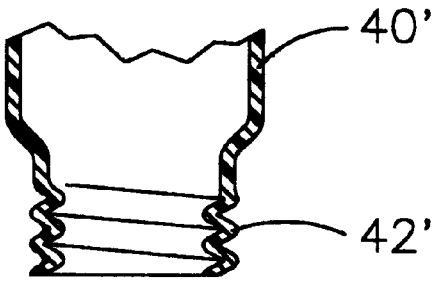
FIG. 14 is a cross sectional view of an alternate configuration for the lower portion of the post that can be used in conjunction with the embodiment illustrated in FIG. 13.

In FIG. 13, a still further embodiment 10D is illustrated in which the bellows 60 is integrally formed with the upper diverging taper 34 which supports the bellows as well as the external threaded region 44. The upper portion 40 is provided with an internal threaded lower portion 42 as in FIG. 6. The embodiment 10A in FIGS. 2–9, however, is preferred because of the additional support that the lower region of the pedestal provides for the vertical load resulting from the weight of the post and the striking pad. In FIG. 14, an alternate upper portion of the post 40' is illustrated in which the lower end of the tubular member is provided with an external thread 42' which would need to be mated with an internal thread provided on the upper end of the lower portion of the post.

Figure 15:
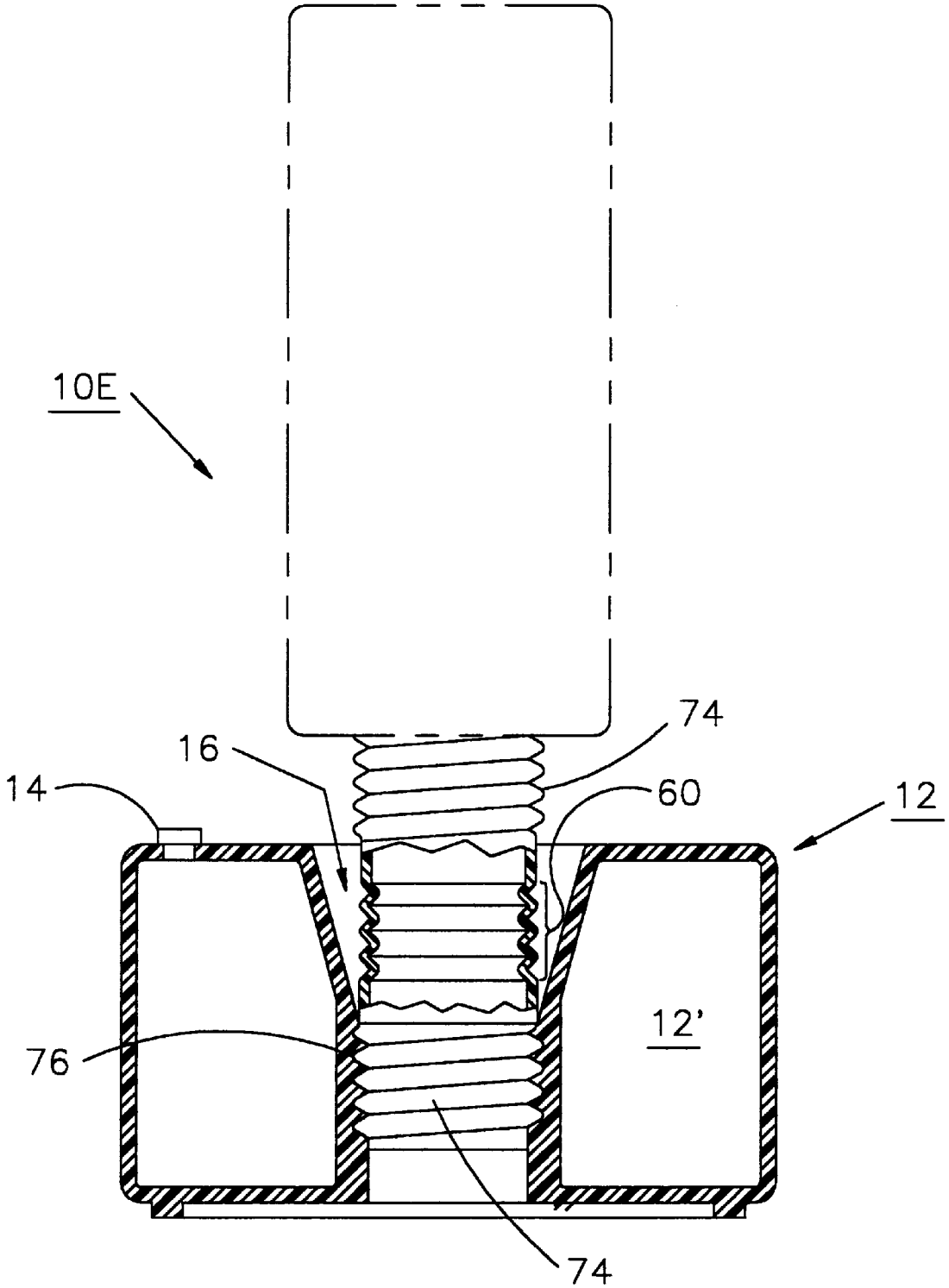
FIG. 15 is a partial cross sectional view of a freestanding bag in accordance with the invention illustrating a further embodiment for mounting the post on the base.
Figure 16:
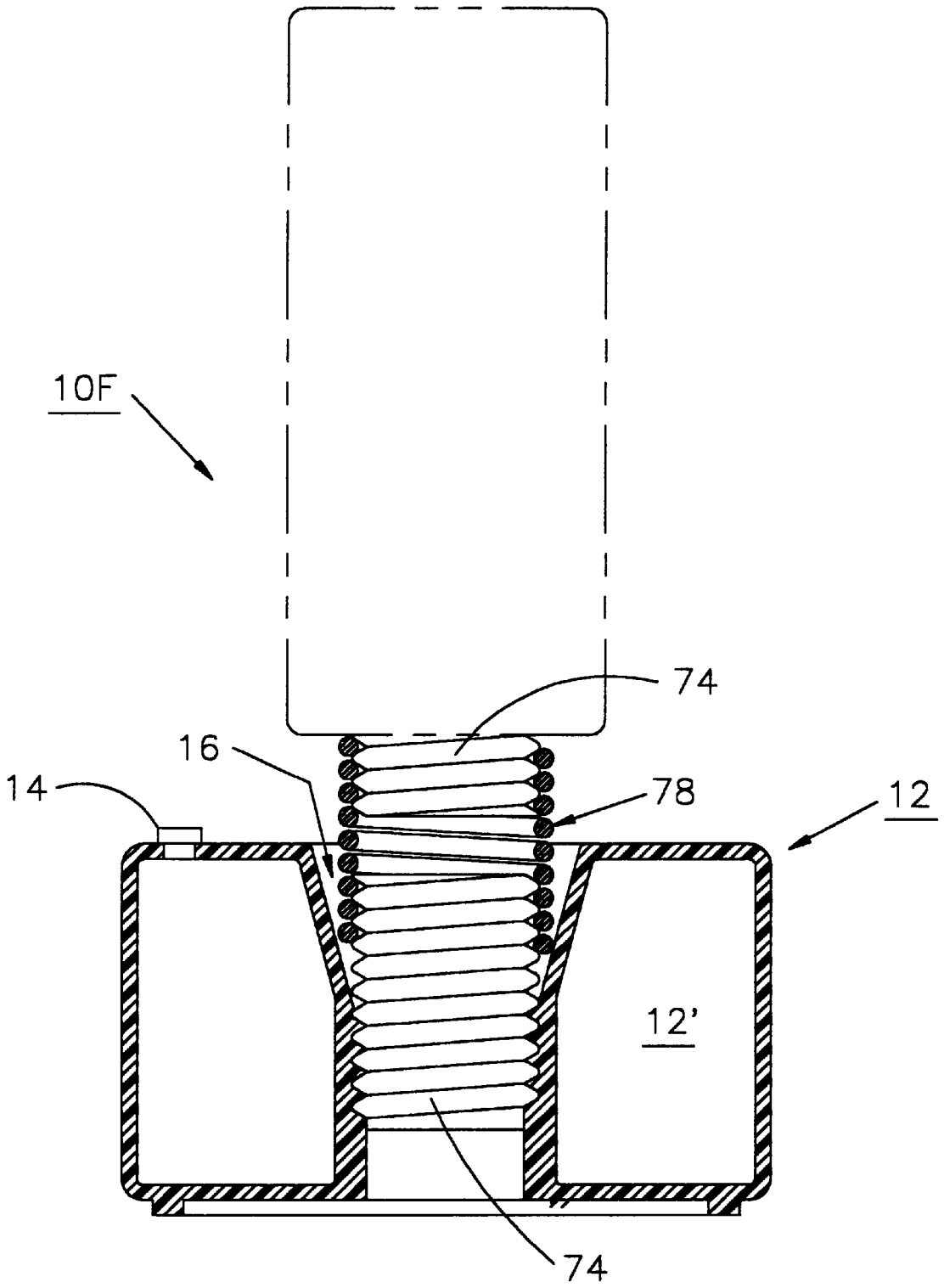
FIG. 16 is similar to FIG. 15, but showing still a further embodiment of the invention.

In FIG. 15, another embodiment 10E is illustrated in which the lower end of the post 46 is provided with an external thread 74 configured to mate with the internal thread 76 formed within the central opening 29. By attaching the post to the pedestal in this manner, further or additional hardware need not be provided. If desired, the external thread 74 may be modified just above the recess 16 to provide a separate profile 76 that may be more suitable to serve as a bellows. Thus, the same tubular portion 46 may be provided with ends that are threaded, for purposes of attachment, while a separate intermediate region may be molded to enhance the properties of that region to serve for flexing or bending. In this connection, a further embodiment 10F is illustrated in FIG. 16 in which a helical spring 78 may be used in place of the central region 76, the spring having a pitch that substantially corresponds to the pitch of the external thread 74 so that the spring can engage and secure opposite, spaced ends of the lower portion 46. It should be clear that the region of the spring 78 that is not in contact with the threaded regions of the lower portion can serve as a very efficient resilient portion R for the intended purpose. Clearly, by changing the spring constants for the spring the characteristics of the training bag can be changed.

Figure 17:
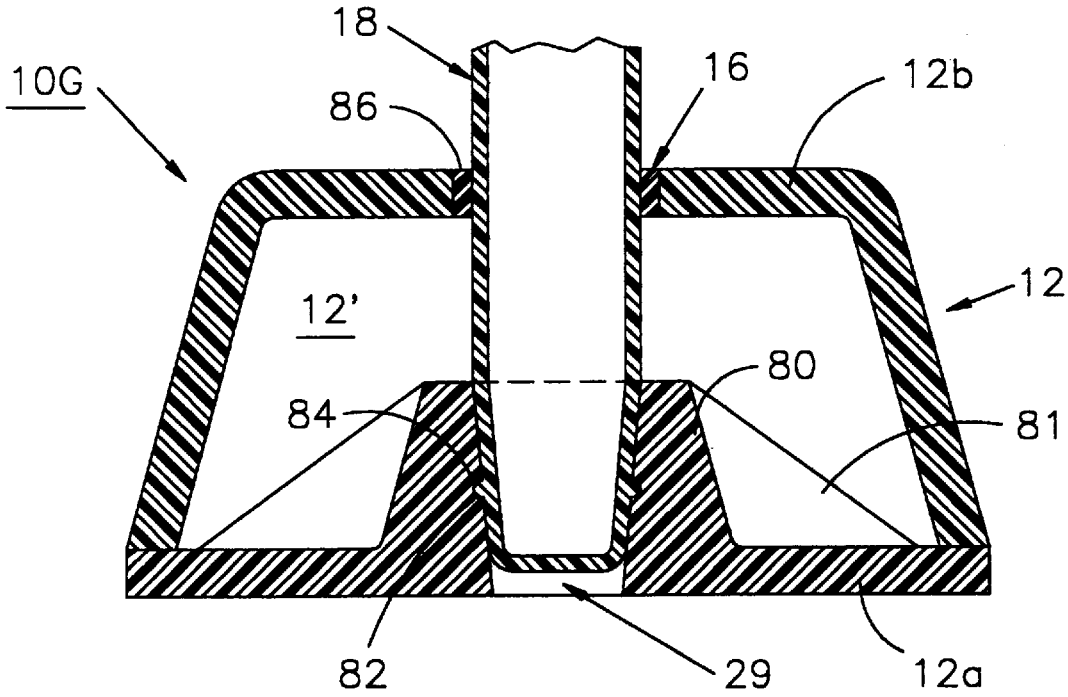
FIG. 17 is a partial cross sectional view of yet a further embodiment of the invention.

In FIG. 17, a further embodiment 10G is illustrated in which the bottom wall 12*a* is provided with generally conical raised region 80 through which the central opening 29 extends. An annular recess or groove 82 is provided on the raised region 80 which snappingly receives an annular projection or ring 84 which may be snapped into the groove. The upper wall 12*b* is provided with an opening or recess 16 for receiving the post, a suitable annular seal or gasket 86 extending about the opening 16, as shown to provide a seal at the top wall 12*b*. If the resulting seals and the top and bottom walls are effective, the pedestal can be filled with liquid, such as water. Otherwise, this embodiment does not inherently provide a sealed container and may be more suitable for use with other fluid mediums, such as sand. If desired the positional integrity of the raised region 80 can be enhanced by internal ribs 81.

Figure 18:
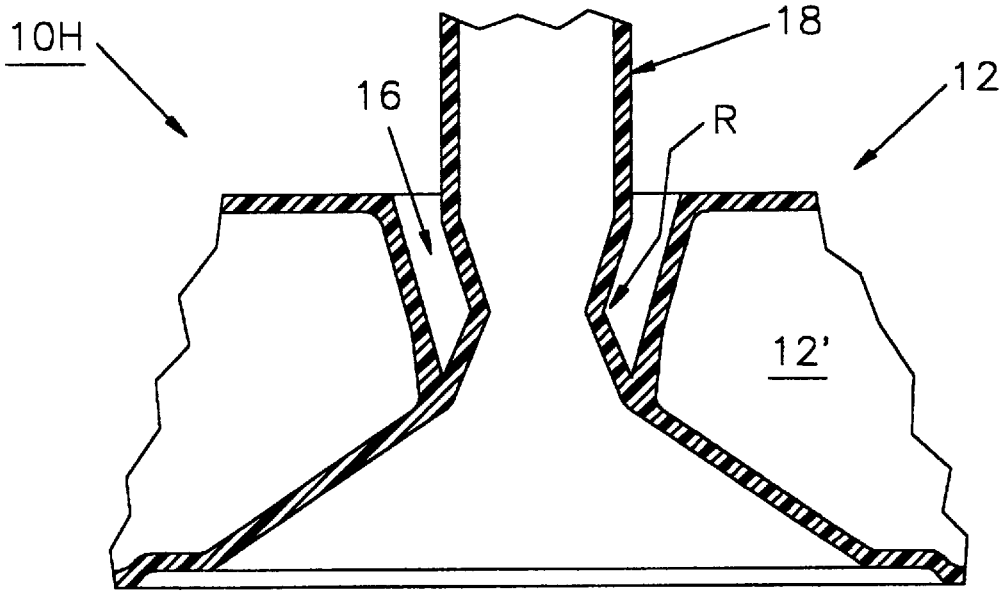
FIG. 18 is similar to FIG. 17, but illustrating an additional embodiment in accordance with the invention.

In FIG. 18, an additional embodiment is illustrated in which the post 18 is integrally formed with the pedestal 12 to provide essentially the same freedom of movements of the post relative to the pedestal.

Figure 19:
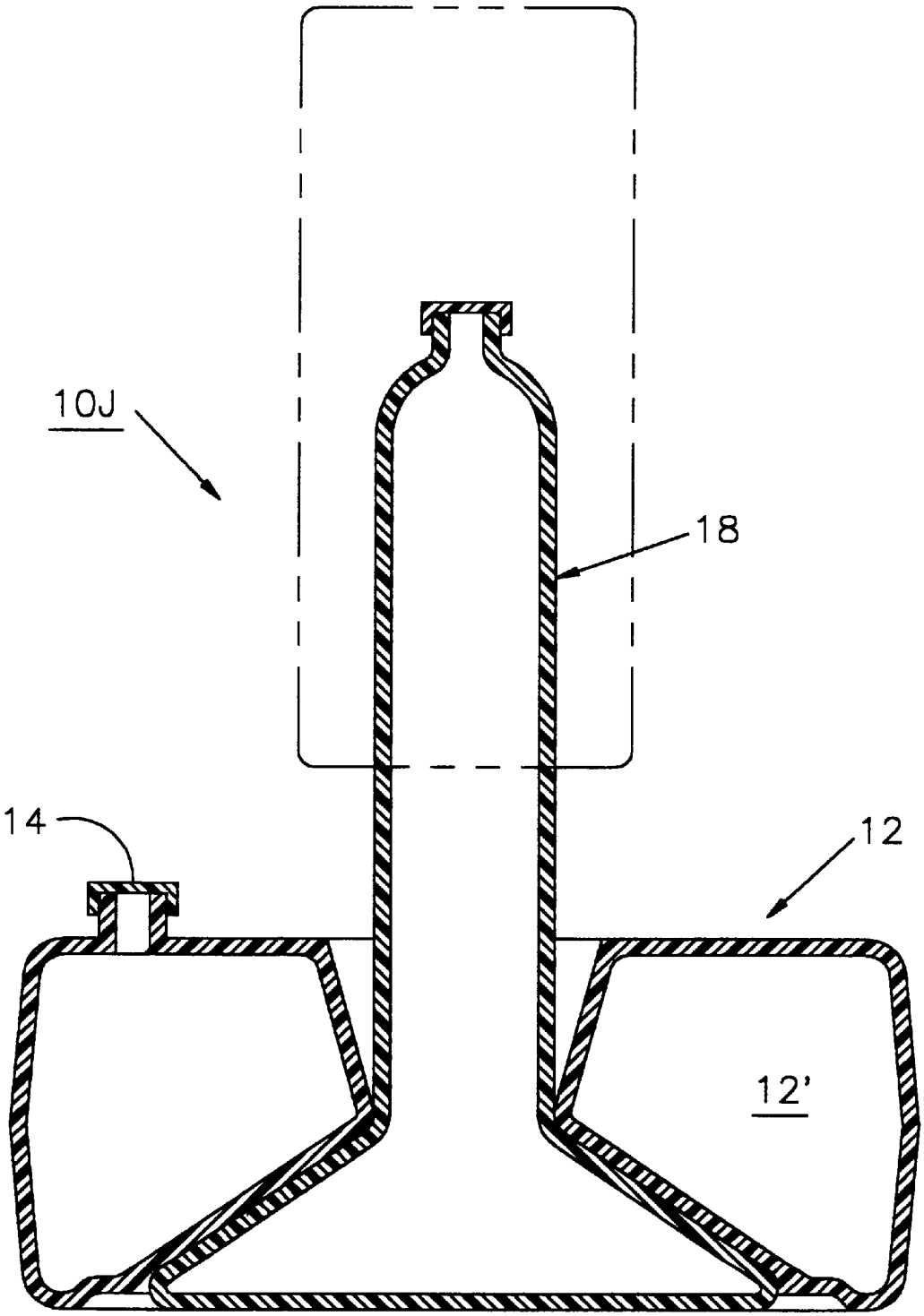
FIG. 19 is similar to FIG. 18, but illustrating yet an additional embodiment in accordance with the invention.

In FIG. 19, another embodiment 10J is illustrated which is similar to the embodiment 10B shown in FIG. 10 except that the post is not provided with a bellows, per se. Under those circumstances, the material and the dimensions of the post must be selected so as to provide sufficient flexibility and resiliency without the need of a separate, distinct resilient portion R. If the post is sufficiently tall in relation to its cross sectional dimensions, the post or column can provide sufficient bending or flexing for the intended purpose. However, significantly better results will normally be obtained with those embodiments that have a separate and distinct resilient portion R that is specifically designed for bending or flexing, such as a bellows or a spring.

Since the pedestal becomes very heavy once filled with water, and it is difficult and inconvenient to replace the water with any degree of frequency, it is desirable to add a bacteriastat to the water to prevent mildew and odor so that the same water can be used for extensive periods of time. For example, a bacteriacide can be used, such as bleach. However, a longer lasting option is preferred. For example, referring to FIG. 11, the plug 14 is shown to be provided with a depending mesh housing N suitable for receiving one or more tablets of a bacteriacide and maintain same at a height just above the water level so that impacts on the post will cause water to splash on the tablets to provide an extended and slow release of the chemical to increase its effectiveness. One such bacteriacide that may be used, in tablet or powder form, is "Envirocil75" sold by Enviro-Chem, Inc., of Walla Walla, Wash. However, other such materials may also be used.

The above described embodiments satisfy the objectives that are important for both consumers and more advanced users. By providing a hollow base that can be filled with a fluid medium, such as water or sand, the unit is sufficient light and easy to handle during shipment and storage, while it can exhibit significant weight once filled with a fluid. The added weight secures or anchors the pedestal to the ground, by friction, enabling the device to stay substantially fixed in place for most anticipated impact forces. Being provided with a resilient member, the post can absorb relatively high impact forces and efficiently convert kinetic energy to potential energy. The stop or limit surfaces, in the form of upper diverging tapered surfaces 34, can, by adjusting the angles $\alpha$ of the taper, control the extent of deflection and, as well, the responsiveness or speed with which the striking pad will rebound to the user after initial impact. All of the embodiments are omnidirectional and a user can kick or hit the striking pad from any direction about the periphery of the base or pedestal. By controlling the stiffness or softness of the resilient portion, as well as the weight of the striking pad and the dimensions of these elements and, importantly, the angle $\alpha$ defined by the upper diverging taper 34, timing and swiftness can be controlled without complex or expensive constructions. The punching bag, therefore, serves the objective of providing rapid and lively rebound to simulate counter-punches by a live opponent. By assembling the training bag from a number of different elements, such as is the case with the embodiment 10A or 10C and by providing a construction that can be readily disassembled to a number of component parts, the unit can be easily stored and shipped in a compact way.

The invention has been shown and described by way of a presently preferred embodiment, and many variations and modifications may be made therein without departing from the spirit of the invention. The invention, therefore, is not to be limited to any specified form or embodiment, except insofar as such limitations are expressly set forth in the claims.

What is claimed is:

1. A freestanding training bag comprising a pedestal having a lower surface on which the pedestal rests during normal use, and an upper surface spaced above said lower surface, said pedestal defining a substantially vertical axis extending through a generally central region of said pedestal and having a recess in said upper surface of said pedestal substantially symmetrically aligned with said vertical axis and extending from said upper surface at least partially towards said lower surface; a generally vertical post having a resilient portion in the region of the lower end of said vertical post extending into said recess and supported on said pedestal at a point below said upper surface, said post being normally substantially vertically aligned with said vertical axis prior to being struck by a user; and a striking pad surrounding said post for being struck by a user, said recess generally being in the shape of at least a portion of an inverted generally tapered surface defining an axis substantially aligned with said vertical axis, allowing predetermined deflection of said post and serving as a limit stop to prevent excessive deflection of said post from said vertical direction before said post bounces back after being struck by the user, whereby striking said striking pad by the user causes said post to deflect a predetermined angle about said resilient portion without bending or deflecting said upper surface of the pedestal.

2. A training bag as defined in claim 1, wherein said pedestal is a generally hollow, substantially sealed container that can be filled with a fluid material to significantly increase the weight of said pedestal.

3. A training bag as defined in claim 1, wherein said recess is generally in the shape of at least a portion of an inverted conical surface defining an axis substantially aligned with said vertical axis, whereby said recess between said conical surface and said post gradually decreases from said upper surface toward said lower surface of said pedestal.

4. A training bag as defined in claim 3, wherein said conical surface defines an angle $\alpha>0°$.

5. A training bag as defined in claim 4, wherein a is selected within the range of 5° to 60°.

6. A training bag as defined in claim 5, wherein a is selected within the range of 5° to 45°.

7. A training bag as defined in claim 6, wherein a is elected to be approximately 13°.

8. A training bag as defined in claim 1, wherein said post is integrally formed with said pedestal.

9. A training bag as defined in claim 1, wherein said pedestal has a central opening along said vertical axis extending between said upper and lower surfaces, said lower end of said post extending through and being captured within said central opening between said upper and lower surfaces.

10. A training bag as defined in claim 9, wherein said central opening includes a constricted region of minimal cross sectional dimensions at a point between said upper and lower surfaces, said post having one longitudinal end dimensioned to be passable through said constricted region and extending beyond said constricted region and above said upper surface, and having another longitudinal end dimensioned to prevent passage through said constricted region, whereby insertion of said one longitudinal end through said constricted region from said lower to said upper surfaces causes said other longitudinal end of said post to engage sai constricted region thereby capturing said post within said pedestal.

11. A training bag as defined in claim 10, wherein said constricted region is formed by a generally conical surface in said central opening having gradually reduced dimensions from said lower surface to a point intermediate said upper and lower surfaces, said other longitudinal end of said post forming a conical surface that generally conforms to said conical surface in said central opening when said post is mounted on said pedestal.

12. A training bag as defined in claim 1, further comprising locking means for locking said post on said pedestal to prevent relative rotational movements between said post and said pedestal about said vertical axes.

13. A training bag as defined in claim 12, wherein said locking means comprises an annular protuberance centered on said axis on one of said post and pedestal and an annular groove centered on said axis on the other of said post and pedestal that can snappingly receive said annular protuberance.

14. A training bag as defined in claim 1, further comprising a resilient material substantially filling said recess.

15. A training bag as defined in claim 1, wherein said resilient portion comprises a flexible bellows formed in said lower end of said post and arranged in the region of said recess.

16. A training bag as defined in claim 1, wherein said resilient portion comprises a flexible bellows connected in line in said lower end of said post.

17. A training bag as defined in claim 1, wherein said resilient portion comprises a helical spring connected in line in said lower end of said post.

18. A training bag as defined in claim 1, further comprising longitudinal ribs on said post generally parallel to said axis for engaging an internal surface of said striking pad to prevent rotation of said striking pad relative to said post about said axis when struck by a user.

19. A training bag as defined in claim 1, further comprising circumferentially arranged protuberances on said post for engaging an internal surface of said striking pad to prevent longitudinal movements along said axis of said striking pad relative to said post when said striking pad is struck by a user.

20. A training bag as defined in claim 1, wherein said post comprises upper and lower portions joined to each other at matingly threaded ends.

21. A training bag as defined in claim 20, wherein said threaded ends are arranged above said resilient portion.

22. A training bag as defined in claim 1, wherein an upper portion of said post most remote from said pedestal has a reduced circular cross section relative to a circular cross section of a main portion of said post between said upper portion and said pedestal; and a post extension; for extending the longitudinal or axial length of said post to accommodate a longer striking pad, having an axial opening for receiving said upper portion of reduced dimensions and having outer dimensions generally corresponding to those of said main post portions.

23. A training bag as defined in claim 1, wherein said resilient portion comprises a hollow flexible bellows having an upper annular portion, said post comprising a hollow tube one end of which is receivable within at least one end of said bellows; and securing means for securing said upper annular portion of said bellows to said one end of said tube.

24. A training bag as defined in claim 23, wherein said securing means comprises a locking band or hose clamp.

25. A training bag as defined in claim 1, wherein said post comprises at least two telescoping tubular portions; and locking means for selectively locking said tubular portions at desired relative positions to accommodate different sized striking pads.

26. A training bag as defined in claim 1, further comprising an annular insert receivable within said recess for decreasing the extent of deflection of said post before rebound.

27. A training bag as defined in claim 1, further comprising means for slow release of a bacteriastat within a liquid filling said pedestal.

* * * * *